US005593340A

United States Patent [19]

Nelson et al.

[11] Patent Number: 5,593,340

[45] Date of Patent: Jan. 14, 1997

[54] CASTABLE OPHTHALMIC LENS POLISHING LAP AND METHOD

[75] Inventors: Thomas E. Nelson, Goleta, Calif.; Erik A. Larsen, Seattle, Wash.

[73] Assignee: DAC Vision, Inc., Carpinteria, Calif.

[21] Appl. No.: 535,887

[22] Filed: Sep. 28, 1995

[51] Int. Cl.[6] ..... B24B 1/00

[52] U.S. Cl. ..... 451/42; 451/53; 451/460; 451/495

[58] Field of Search ..... 451/42, 56, 533, 451/495, 240, 255, 256, 277, 323, 921, 504, 505, 548, 488, 495, 490

[56] References Cited

U.S. PATENT DOCUMENTS

| | | |
|---|---|---|
| 3,404,488 | 8/1965 | Cox et al. . |
| 3,583,111 | 6/1971 | Volk . |
| 3,594,963 | 7/1971 | Beasley . |
| 4,010,583 | 3/1977 | Highberg . |
| 4,089,102 | 5/1978 | Soper et al. . |
| 4,598,502 | 7/1986 | Lombard . |
| 4,979,337 | 12/1990 | Duppstadt . |
| 4,989,316 | 2/1991 | Logan . |
| 5,205,083 | 4/1993 | Pettibone . |
| 5,320,006 | 6/1994 | Blocha et al. . |
| 5,345,725 | 9/1994 | Anthony . |

FOREIGN PATENT DOCUMENTS

| | | |
|---|---|---|
| 853920 | 10/1970 | Canada . |
| 0655297 | 5/1995 | European Pat. Off. . |
| 57-41155 | 3/1982 | Japan . |

OTHER PUBLICATIONS

Semi–Tech, Inc. Optical Equipment and Supply Catalog, Opti–Speed 2100 Surface and Polish Machine, 1993.

*Primary Examiner*—Bruce M. Kisliuk
*Assistant Examiner*—George Nguyen
*Attorney, Agent, or Firm*—Koppel & Jacobs

[57] ABSTRACT

A single castable ophthalmic lens polishing lap includes a mounting plate that is adapted for connection to a lap press/cylinder machine and includes a flexible membrane that is affixed to the mounting plate and filled with castable material. A polishing pad is affixed to the flexible membrane. The lap is cast by first applying energy to the castable material that causes it to soften, and to preferably change to a fluid phase, and then pressing the lap against the rough cut back surface of a lens. This causes the castable material to deform so that the lap's curvature is complementary to the lens' prescription curvature. Energy is then removed from the lap so that the castable material solidifies in the desired shape. After polishing, the lap can be recast with another lens having a different prescription.

20 Claims, 3 Drawing Sheets

CASTABLE OPHTHALMIC LENS POLISHING LAP AND METHOD

BACKGROUND OF THE INVENTION

1. Field of the Invention

The present invention generally relates to ophthalmic lens polishing laps, and more specifically to a castable lens polishing lap that can be deformed and cast to conform to different prescription lens curvatures.

2. Description of the Related Art

Lenses for certain types of eyeglasses are manufactured by utilizing a lens blank which is cast with a completed front curvature and an unfinished back surface. The lens' front surface is "blocked" to a metal mandrel by a variety of techniques such as a layer of plastic. The blocked lens is placed in a lathe or generator to machine the back surface of the lens. As shown in FIG. 1, existing generators such as the SG-8 produced by Gerber Scientific Products, Inc., machine the back surface of a lens 2 to roughly a prescription curvature 4. The rough cut 6 is characterized by errors in curvature, commonly called form errors, and roughness errors, approximately 30 μm peak-to-valley. The rough cut 6 may or may not accurately represent the desired prescription 4, and thus is not considered to form the prescription but merely to provide a rough approximation. The surface that is produced is either spherical or toric (rotationally non-symmetric) in shape and requires a lapping and polishing operation to first form the prescribed curvature and then to smooth the surface.

Industry practice is to use hard laps, typically aluminum, with abrasive and soft pads to respectively fine and polish the back surface of the lens. The laps are pre-machined with the precise major and minor axis curvatures specified by a particular prescription. The lap and lens are placed in a cylinder machine such as the Opti-Speed® 2100 Surface and Polish Machine with their respective major and minor axes precisely aligned to each other. The cylinder machine rubs the pad against the back surface of the lens in a controlled manner to both grind the lap's curvature into the lens to remove form errors and to smooth the back surface. First, a highly abrasive pad is attached to the lap and rubbed against the lens for 1 minute. The high abrasive pad is replaced with a less abrasive pad which rubbed against the lens for 2 minutes. Finally, a felt polishing pad is saturated with an aluminum oxide liquid abrasive and used to polish the lens for 4 minutes.

A lens laboratory will typically have thousands of metal laps to produce the spherical shapes of varying radii and the many combinations of toric shapes that are required. Furthermore, the laps are only available with a resolution of 0.125 Diopters between successive laps. Thus, the actual prescription ground into the back surface of the lens may be up to 0.0625 Diopters different then the desired prescription. The purchase and maintenance of thousands of metal laps is expensive and requires a large amount of space. Furthermore, the aluminum laps become damaged over time which changes their effective curvature.

Some generators are able to produce both the lens and a plastic lap, which has a convex surface that is complementary to the concave back surface of the lens. A separate lap must still be generated for each radii and combination of toric shapes. The plastic laps are less expensive then the metal laps and do not require the same storage space. However, the production of the plastic lap takes time which prevents the generator from being utilized to machine lenses. Furthermore, the precision of the plastic lap is limited to the rough cut precision of the lens' back surface.

U.S. Pat. No. 5,345,725 "Variable Pitch Lapping Block for Polishing Lenses" to Anthony discloses an expandable rubber bladder whose curvature is adjusted by varying the air pressure on the inner surface of the bladder. The bladder is held against a lens' unfinished surface and pressurized until it conforms to the curvature of the lens. Stretching the bladder creates spring forces or aberrations which vary across its surface. As a result, rubbing the bladder against the lens creates waves in the surface of the lens. Furthermore, the bladder can change shape during the polishing action.

SUMMARY OF THE INVENTION

The present invention seeks to provide a single castable ophthalmic lens polishing lap that can be cast and recast to match the different back surface prescription curvatures for a plurality of lenses thereby reducing finishing time and storage requirements and increasing the available curvature resolution.

This is accomplished with a mounting plate that has a back surface adapted for connection to a lens polishing machine. A flexible membrane is affixed to the front surface of the mounting plate and filled with castable material. The flexible membrane conforms to the shape of the castable material. A polishing pad is affixed to the surface of the flexible membrane.

The lap is cast by first applying energy to the castable material that causes it to soften, and to preferably change to a fluid phase, and then by pressing the lap against the unfinished back surface of a lens. This causes the castable material to deform so that the pad's curvature is complementary to the prescription curvature formed on the back surface of the lens. Energy is then removed from the lap so that the castable material solidifies in the desired shape.

The lens is finished by rubbing the lap against its back surface to smooth irregularities in the unfinished prescription curvature. The lap can then be recast with another lens having a different prescription.

For a better understanding of the invention, and to show how the same may be carried into effect, reference will now be made, by way of example, to the accompanying drawings.

DETAILED DESCRIPTION OF THE INVENTION

The present invention provides a single castable ophthalmic lens polishing lap to replace the thousands of precast metal laps. The lap includes a flexible membrane that is filled with castable material and affixed to a mounting plate. A polishing pad is affixed to the surface of the membrane. The castable material preferably exhibits a controlled, rapid and reversible solid-to-fluid phase change in response to a change in energy. This allows the lap to be pressed against the rough cut back surface of a lens to form a complementary curvature. Because the lap undergoes a phase change, the forces along the surface of the lap are uniform, and hence do not create aberrations in the lens during polishing. Furthermore, the lap can be recast to other unfinished lenses with different prescription curvatures.

Metal alloys such as a lead cadmium alloy and wax compounds change phase in response to thermal energy. The lap is heated above the material's melting point and pressed against the lens such that they form a matched pair. The lap is then cooled, either passively by exposure to the atmosphere or actively by removing thermal energy from the lap, such that the material solidifies with the desired curvature.

Figure 1:
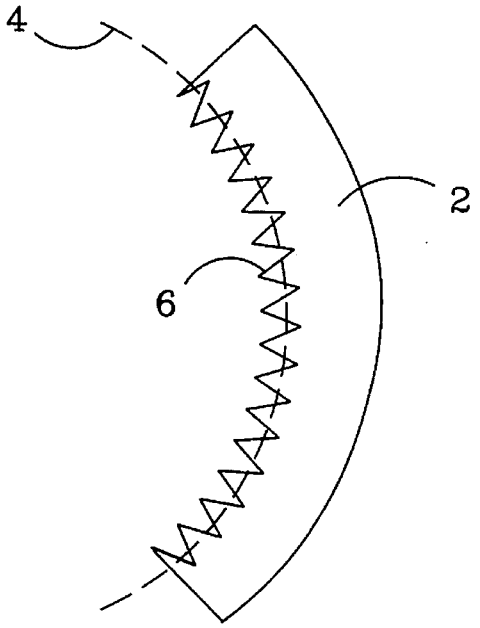
FIG. 1 (Prior Art)
FIG. 1, as described above, is a sectional view of a known rough cut lens.
Figure 2:
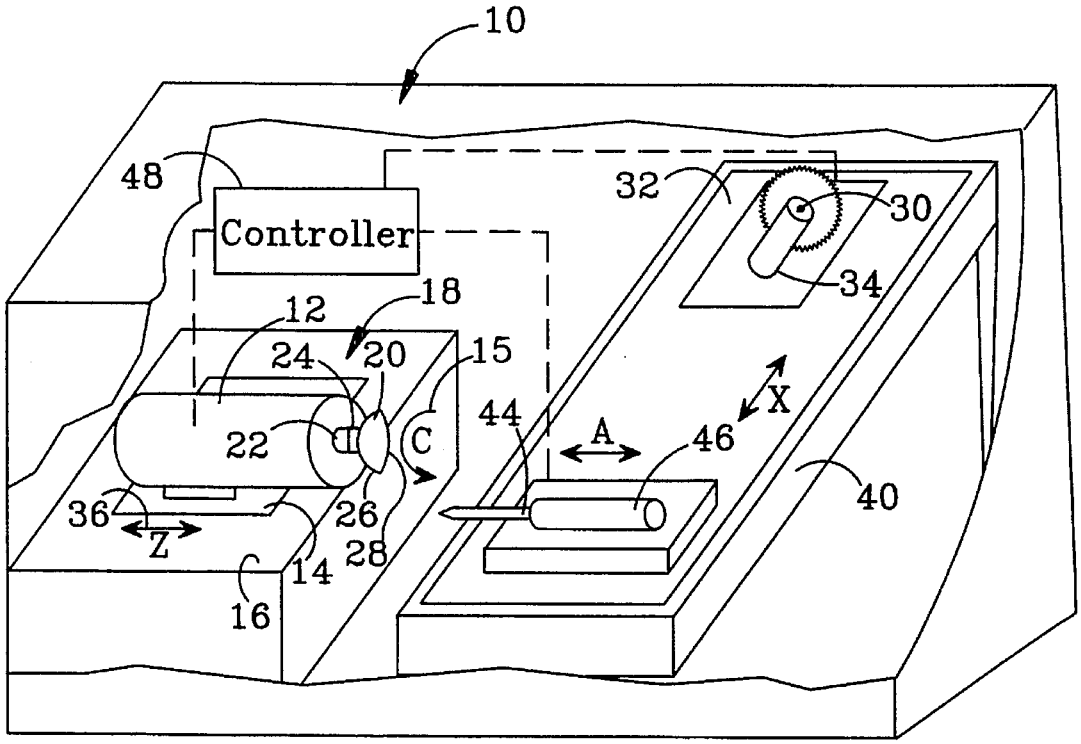
FIG. 2 is a perspective view of a preferred lens generator illustrating respectively gross and fine cutting tools for forming the rough cut on the back surface of a lens and their relative axes of movement.

The cast lap is rubbed against the lens to fine or polish the rough surface. Because the lap and lens form a matched pair, rubbing the lap against the lens does not grind the desired prescription into the lens but merely smooths the existing curvature to remove small form and roughness errors. As discussed previously, the rough cut formed by existing generators does not consistently represent the desired prescription. Hence, a high speed 4-axis generator 10 such as shown in FIG. 2, which is capable of forming a rough cut on the back surface of a lens with a resolution of at least 0.001 Diopters and a roughness of approximately 6 μm peak-to-valley, is preferred.

The preferred 4-axis generator 10 includes a spindle 12 that is mounted on a z-axis slide 14 and rotates around a c-axis 15. The slide 14 sits on a table 16. A blocked lens assembly 18 includes a lens 20 that is blocked to a metal mandrel 22 by a layer of plastic 24. The lens 20 has a completed front surface 26 and an unfinished back surface 128. The metal mandrel 22 is adapted for connection to the spindle 12 as well as the lap press shown in FIG. 5 and the cylinder machine shown in FIG. 6.

The rough cut is done in two steps: a gross cut and a fine cut. The gross cut is performed by a cutting disk 30, the periphery of which is provided with a series of cutting teeth 32. A spindle 34 rotates the cutting disk in a plane orthogonal to the back surface 28 of the lens. To bring the cutting disk 30 and lens 20 together, and to control the cut depth, the spindle 12 on which the lens is mounted can move horizontally on the z-axis slide 14 along the z-axis as indicated by double-ended arrow 36. The cutting disk 30 is mounted on a x-axis slide 38 on table 40 which allows it to translate vertically along the x-axis as indicated by double-ended arrow 42. The z-axis slide 14, and hence the lens 20 are moved parallel to the z-axis, in coordination with the movement of the cutting disk 30 along the x-axis, to cut a symmetrically curved surface into the back surface 28 of the lens 20.

To roughly (not to prescription) establish the asymmetric toric shape, the lens is oscillated back and forth parallel to its gross movement along the z-axis. This oscillation is coordinated with the lens' rotation about the c-axis. For example, two full oscillations can be made for each complete lens blank rotation, so that a deeper cut is made at 0° and 180° rotation, and a shallower cut at 90° and 270°. This establishes the desired asymmetry for the back surface of the lens. During this process the lens is rotated relatively slowly, approximately 50 rpm.

In the fine cut phase, the cutting disk 30 is replaced with a smaller cutting tool 44 that has a pointed diamond cutting tip by translating the x-axis slide 38. Cutting tool 44 is mounted on a linear air slide 46 that is positioned on the x-axis slide 38 and translates along an A-axis that is parallel to the z-axis and orthogonal to the x-axis. During the fine cut, cutting tool 44 rather than the lens 20 is oscillated to establish the toric symmetry, parallel to the A-axis. Since the mass of the air slide 46 is much less than that of the lens spindle 12 or the x-slide 38, the oscillations can be made much faster and the lens blank rotation speeded up to approximately 1200 rpm during the fine cut. This greatly improves the smoothness of the lens' back surface from approximately 30 μm in known generators to approximately 6 μm or less and reduces form errors. The lens moves parallel along the z-axis and the cutting tool moves along the x-axis, as in the gross cut, to establish the basic curvature, while the cutting tool's oscillation establishes the symmetry.

A controller 48 for the 4-axis generator 10 may vary widely as to its details, but includes a servo controller, a computer, and a keyboard for inputting prescription data. The computer with the aid of well known numerical programs converts the prescription data to a set of data points in the z, x, c and A planes and issues commands to the servo controller to drive the z, x and A-axis slides to execute the gross and fine cuts. The controller senses the instantaneous positions of the slides and adjusts the servo controller accordingly to provide closed loop control.

Figure 3:
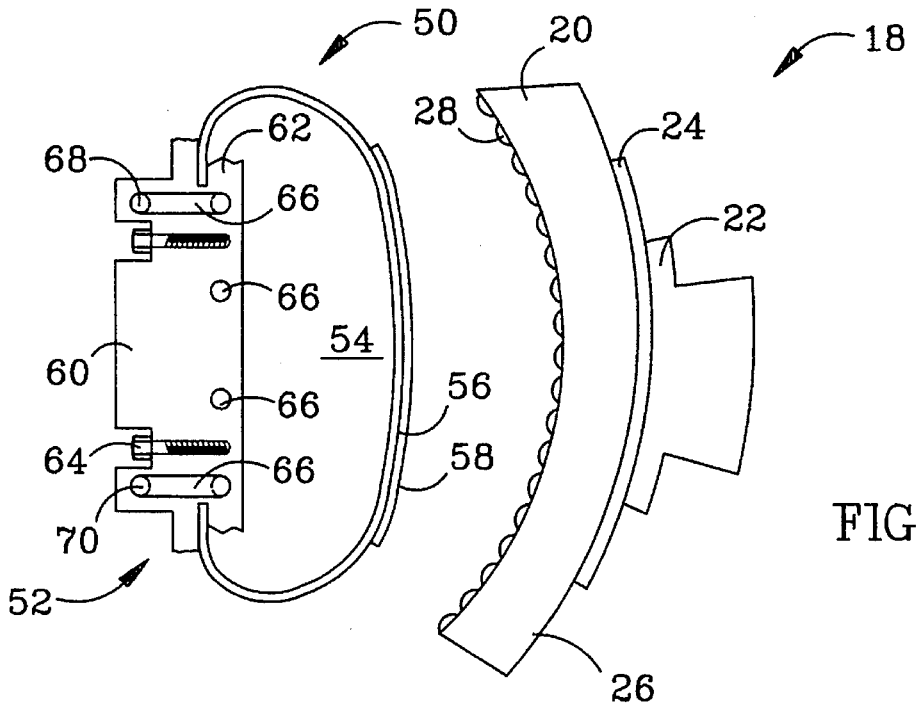
FIG. 3 is sectional side view of a castable ophthalmic lens polishing lap in accordance with the present invention and a blocked lens having a rough cut back surface.

As shown in FIG. 3, a castable ophthalmic lens polishing lap 50 in accordance with the present invention includes a mounting plate 52, a mass of castable material 54 such as a lead cadmium alloy, and a flexible membrane 56 that is affixed to the mounting plate and encases the castable material. The lead cadmium alloy has a melting temperature of approximately 125° F. and changes phase completely within approximately ±10° F. of the melting temperature. Thus, at the ambient operating temperature, which is typically about 72° F., the alloy is solid. The membrane 56 is formed from an elastic material such as vinyl that conforms to the shape of the castable material and has a much higher melting temperature.

An abrasive or polishing pad 58 is placed on the front surface of the membrane. The abrasive and polishing pads are made with a uniform thickness so that they can be interchanged without affecting the lap's curvature. The pads are typically adhered to the membrane. Alternately, the membrane could be formed with an abrasive surface capable of gripping the pad without using adhesive.

Figure 4:
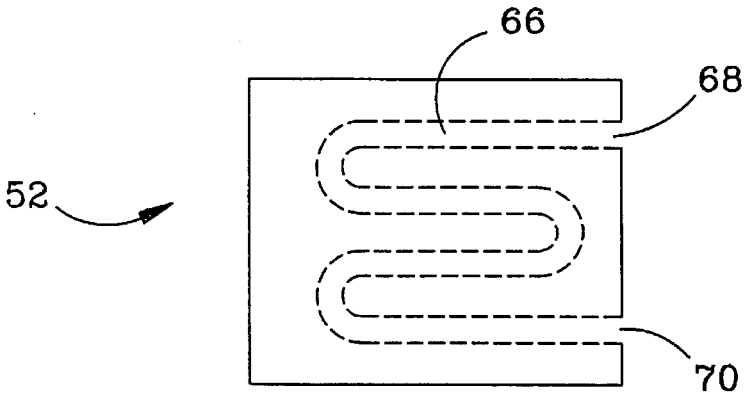
FIG. 4 is sectional back view of the lap shown in FIG. 3 illustrating a water conduit for heating and cooling the lap.

The mounting plate 52, typically copper, includes a bracket 60 that is adapted for connection to a lap press and combination lap press/cylinder machine (shown in detail in FIGS. 5 and 6, respectively) and a retainer plate 62 that clamps the flexible membrane 56 against bracket 60. A pair of screws 64 hold the bracket 60 and retainer plate 62 together. The mounting bracket 60 and retainer plate 62 are preferably formed with a conduit 66 and input and output ports 68 and 70, respectively. Thermal energy is applied to the castable material by circulating hot liquid, typically water, through the conduit 66 via ports 68 and 70. Similarly, thermal energy is removed from the lap by circulating cold liquid through the conduit 66. As shown in FIG. 4, the conduit 66 has a serpentine shape that increases heat transfer between the conduit and the castable material 54.

Figure 5:
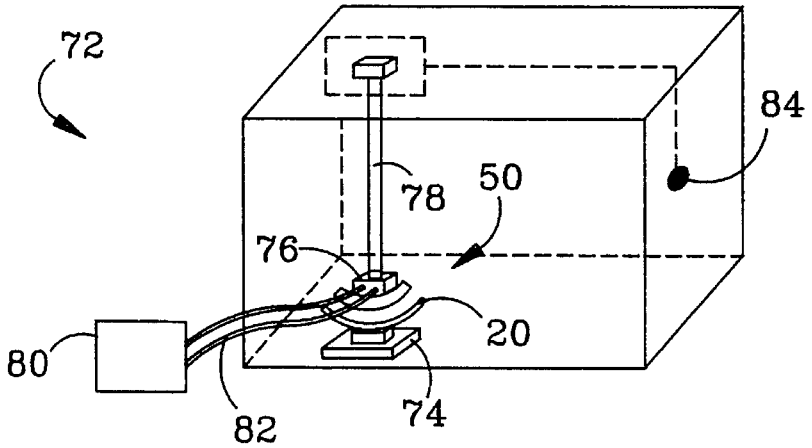
FIG. 5 is a perspective view of a lap press.

FIG. 5 is a perspective view of a lap press 72 for pressing the lap 50 against lens 20 to form the complementary curvature. The lap press 72 includes a mounting bracket 74 for holding lens 20 in a vertical position. A mounting bracket 76 for holding lap 50 is attached to an air cylinder 78 that is suspended above mounting bracket 74. A heating/cooling unit 80 circulates hot/cold water through the lap via tubes 82 that are connected to ports 68 and 70.

To cast lap 50, unit 80 circulates hot water through the lap causing the metal alloy to soften and preferably change phase to a fluid. A user pushes a button 84 to actuate air cylinder 78 which in turn exerts approximately 35 lbs of pressure on the lap against the lens. This causes the lap to deform and conform to the curvature of the lens' back surface 28. Cold water is then circulated through conduit 66 causing the castable material to return to its solid phase and retain the complementary curvature. The lap and lens are removed from the lap press and placed in a cylinder machine for polishing. Their major and minor axes must be carefully aligned to reduce smoothing errors due to mismatch.

In the vertical alignment where the lap is suspended above the lens, gravity pulls the fluid material downward so that the membrane 56 conforms to the lens' curvature. Alternately, the lens could be suspended above the lap. However, in this position, gravity works against the desired result. To achieve the same performance, the press would have to exert more pressure for a longer period of time.

Alternately, the lap could be heated with an electrical coil and allowed to cool passively. However, this is not as efficient and may cause a safety problem since the lap and lens are continuously lubricated during finishing. Furthermore, the lap can be cast by immersing it in hot water until it becomes fluid, placing it in the lap press, and then molding it to the lens.

Figure 6:
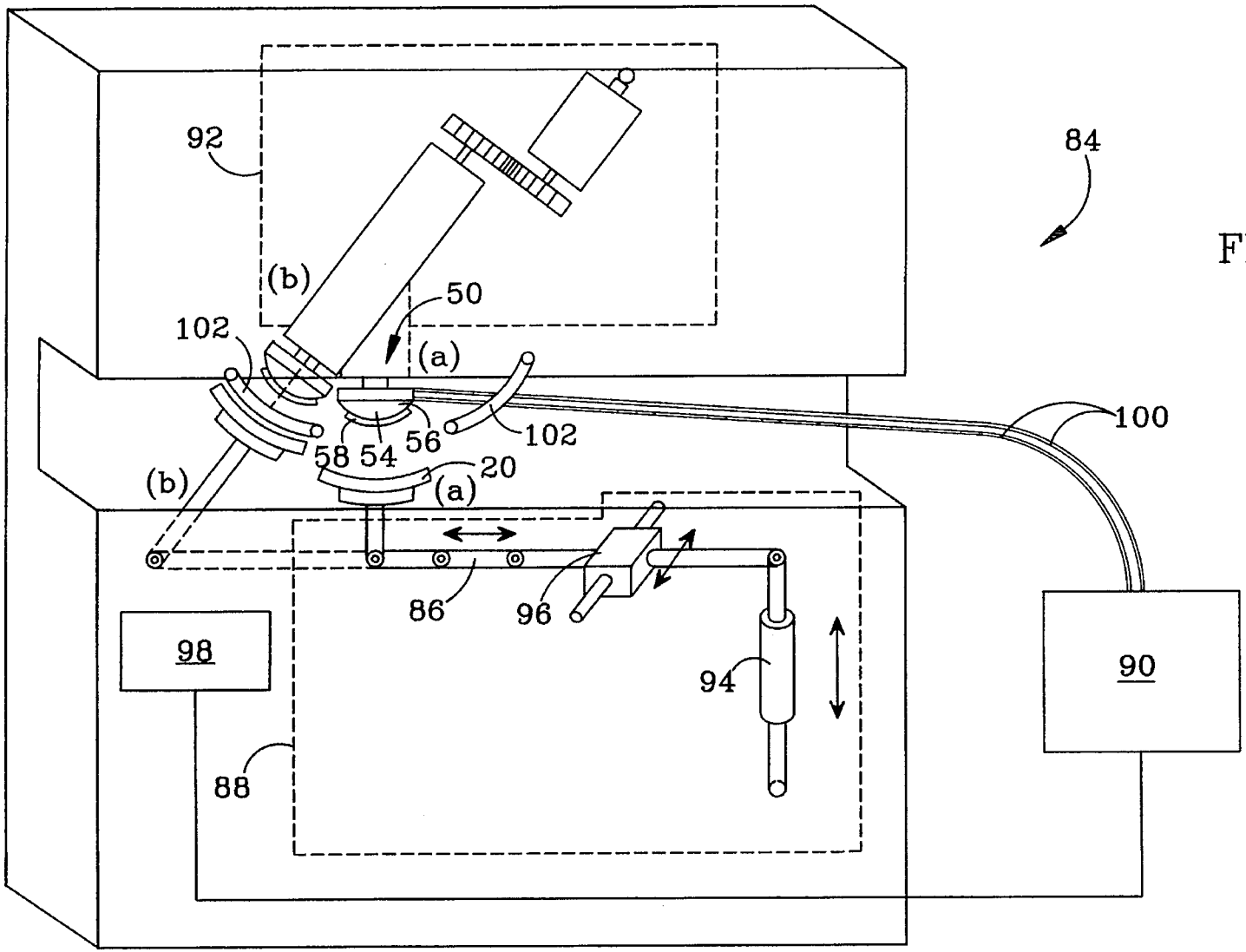
FIG. 6 is a perspective view of a preferred lap press/cylinder machine that both casts the lap to the curvature of the lens and rubs the lap against the lens to polish its back surface.

FIG. 6 shows a preferred embodiment of a combination lens press/cylinder machine 85. This machine is similar to the Opti-Speed® 2100 Surface and Polish Machine (the cylinder machine) with three significant changes. First, the lap 50 is suspended above the lens 20 to take advantage of the gravitational force to cast the lap. Second, an additional air cylinder 86 is included in the lens drive mechanism 88 to position the lens in vertical alignment with lap 50 for casting and to position the lens for polishing. Third, a heating/cooling unit 90 is provided for circulating hot and cold water through the lap. By combining the casting and polishing functions, the lens and lap do not have to be realigned. This self-alignment property reduces mismatch and improves the quality of the finished surface.

The lens press/cylinder machine 85 includes a two-bearing lap drive mechanism 92 commonly called a Haglebearing. The Haglebearing superimposes a first orbit of motion on top of a second orbit of motion to rub the lap 50 against lens 20. The lens drive mechanism 88 includes an air cylinder 94 that actuates the lens vertically to hold it against the lap to both cast and polish the lap. A crank arm and link 96 drive the lens laterally to provide the desired side-to-side movement for polishing the lens. The lens 20 also rocks back-and-forth in response to the motion of the lap 50. Air cylinder 94 drives the lens between the vertical casting position and a polishing position that is substantially in line with the Haglebearing axis. A controller 98 controls heating/cooling unit 90 to change the phase of the lap's castable material 54 and coordinates the motion of Haglebearing 92 and drive mechanism 88 in a well known manner to polish the lens 20.

To cast the lap 50, it is attached to Haglebearing 92 and lens 20 is attached to drive mechanism 88. Two pieces of tubing 100 are attached between the heating/cooling unit 90 and the lap's input and output ports 68 and 70 shown in FIG. 4. Controller 98 directs unit 90 to circulate hot water through the tubing and lap conduit 66 (see FIG. 4) for a predetermined period, approximately 1 minute, to raise the temperature of the castable material 54 above its melting temperature causing it to soften, and preferably to change phase to a fluid. Haglebearing 92 is moved to position (a) in which lap 50 is vertical and air cylinder 86 is actuated to align the lens 20 with the lap 50. Thereafter, air cylinder 94 raises lens 20 and presses it against lap 50 causing the softened or fluid castable material 54 to deform such that the curvatures of flexible membrane 56 and polishing pad 58 form a match with the prescription curvature on the back surface of lens 20. The controller 98 directs unit 90 to circulate cold water through the lap 50 to lower its temperature and resolidify the castable material 54. When the material hardens, the membrane 56 retains its complementary curvature such that the lap 50 and lens 20 form a matched pair.

To polish lens 20, Haglebearing 92 is returned to its polishing position (b) and air cylinder 86 is actuated to align the lens with the Haglebearing axis. The controller 98 coordinates the motion of crank arm 96 and Haglebearing 92 in a well known manner to rub the lap against the lens to smooth the lens and remove small form errors. A pair of conduits 102 are positioned to continuously supply an aluminum-oxide liquid that saturates the polishing pad 58. Aluminum-oxide is a fine abrasive that also performs a chemical etching to smooth the lens surface. In the preferred mode of using the lap 50, a single felt polishing pad is used to finish the lens. However, if the rough cut provided by the generator is too rough such as would be provided by existing generators, the time required to smooth the surface with the polishing pad would be too long. In this case, one or more abrasive pads would be used to fine the surface before using the polishing pad to finish the lens.

While several illustrative embodiments of the invention have been shown and described, numerous variations and alternate embodiment will occur to those skilled in the art. Such variations and alternate embodiments are contemplated, and can be made without departing from the spirit and scope of the invention as defined in the appended claims.

We claim:

1. A castable ophthalmic lens polishing lap, comprising:

a mounting plate having a front surface;

a mass of castable material disposed on and contacting the front surface of the mounting plate and protruding outward from the front surface; and a flexible membrane that is affixed to said mounting plate and encases said castable material so that the flexible membrane has an initial convex shade when in a relaxed state, said castable material having a fluid phase in which it can be deformed to deform said membrane into a desired convex shape different from said initial shape without creating non-uniform forces along the surface of said membrane, and having a solid phase in which it retains the desired convex curvature.

2. The castable ophthalmic lens polishing lap of claim 1, wherein said castable material is in its solid phase under ambient conditions and responds to the application of energy by changing to its fluid phase.

3. The castable ophthalmic lens polishing lap of claim 2, wherein the castable material responds to the application of thermal energy through said mounting plate.

4. The castable ophthalmic lens polishing lap of claim 3, wherein said castable material has a melting temperature greater than 72° F.

5. The castable ophthalmic lens polishing lap of claim 4, wherein said castable material changes phase over a temperature range of no more than ±10° F. of said melting temperature.

6. The castable ophthalmic lens polishing lap of claim 4, wherein said castable material is a metal alloy.

7. The castable ophthalmic lens polishing lap of claim 1, wherein said mounting plate comprises a bracket that is adapted for connection to a lens polishing machine and a retainer plate that is positioned between the bracket and said mass to clamp the membrane between itself and the bracket.

8. The castable ophthalmic lens polishing lap of claim 1, further comprising a polishing pad that is affixed to the surface of the flexible membrane.

9. A castable ophthalmic lens polishing lap, comprising:

a mounting plate having a front surface and a conduit for circulating a liquid to apply thermal energy to the lap;

a mass of castable material disposed on the front surface of the mounting plate; and a flexible membrane that is affixed to said mounting plate and encases said castable material, said castable material having a fluid phase in which it can be deformed such that said membrane has a desired curvature and having a solid phase in which it retains the desired curvature, said castable material being in its solid phase under ambient conditions and responding to the application of thermal energy by changing to its fluid phase.

10. A castable ophthalmic lap for polishing a lens, said lens' back surface being roughly cut to a predetermined concave curvature, comprising:

a mounting plate having a front surface;

a mass of castable material disposed on the front surface of the mounting plate and protruding outward from the front surface, said castable material being in a solid phase under ambient conditions;

a flexible membrane that is affixed to said mounting plate and encases said castable material so that the flexible membrane has a convex curvature; and a polishing pad on the surface of said flexible membrane, said castable material responding to the application of energy to the lap and pressure from the back surface of said lens against the polishing pad by deforming so that the membrane's convex curvature is deformed to a curvature that it is complementary to the lens' predetermined concave curvature without creating non-uniform forces along the surface of said membrane, said castable material responding to the removal of energy from the lap by solidifying such that said membrane retains its complementary convex curvature.

11. The castable ophthalmic lap of claim 10, wherein said castable material responds to the application of thermal energy by undergoing a solid-to-fluid phase change and to the removal of thermal energy by undergoing a fluid-to-solid phase change.

12. A castable ophthalmic lens polishing lap for polishing a lens, said lens' back surface being roughly cut to a predetermined curvature, comprising:

a mounting plate having a front surface and a conduit for circulating a liquid to apply thermal energy to the lap.;

a mass of castable material disposed on the front surface of the mounting plate, said castable material being in a solid phase under ambient conditions;

a flexible membrane that is affixed to said mounting plate so that said membrane encases said castable material; and a polishing pad on the surface of said flexible membrane, said castable material responding to the application of thermal energy to the lap and pressure from the back surface of said lens against the polishing pad by undergoing a solid-to-fluid phase change and deforming so that the membrane's curvature is complementary to the lens' predetermined curvature, said castable material responding to the removal of thermal energy from the lap by undergoing a fluid-to-solid phase change such that said membrane retains its complementary curvature.

13. An ophthalmic lens polishing assembly for use with a lap press, comprising:

an ophthalmic lens having a polished front surface and an unpolished back surface that is roughly cut to a predetermined concave curvature;

a mandrel attached to said ophthalmic lens' front surface, said mandrel being adapted for connection to the lap press;

a mounting plate having front and back surfaces, said plate's back surface being adapted for connection to said lap press;

a mass of castable material disposed on the front surface of the mounting plate and protruding outward therefrom;

a flexible membrane that is attached to said mounting plate and encases said castable material so that the flexible membrane has a convex shape; and a polishing pad on the surface of the membrane, said polishing pad being pressed against the back surface of said lens in response to force applied to at least one of said mandrel and said mounting plate by the lap press so that the application of energy to the lap causes the membrane to conform to the lens' predetermined concave curvature without creating non-uniform forces along the surface of said membrane.

14. The ophthalmic lens polishing assembly of claim 13, wherein the predetermined concave curvature of the lens' unpolished back surface is substantially the same as a desired prescription concave curvature.

15. The castable ophthalmic lap of claim 14, wherein said castable material responds to a change in thermal energy by undergoing a reversible solid-to-fluid phase change.

16. An ophthalmic lens polishing assembly for use with a lap press, comprising:

an ophthalmic lens having a polished front surface and an unpolished back surface that is roughly cut to a predetermined curvature that is substantially the same as a desired prescription curvature;

a mandrel attached to said ophthalmic lens' front surface, said mandrel being adapted for connection to the lap press;

a mounting plate having front and back surfaces and a conduit for circulating a liquid to apply thermal energy to the lap, said plate's back surface being adapted for connection to said lap press;

a mass of castable material disposed on the front surface of the mounting plate;

a flexible membrane that is attached to said mounting plate and encases said castable material; and a polishing pad on the surface of the membrane, said polishing pad being pressed against the back surface of said lens so that the application of thermal energy to the lad causes the castable material to undergo a reversible solid-to-fluid phase change so that the membrane to conforms to the lens' predetermined curvature.

17. A method for casting an ophthalmic lens polishing lap, comprising:

providing a lens having a rough cut concave back surface with a prescription concave curvature;

providing an ophthalmic lens polishing lap that includes a mounting plate with a front surface, a mass of castable material on the front surface of the mounting plate and protruding therefrom, a flexible membrane affixed to said mounting plate and encasing said mass so that the flexible membrane has a convex curvature, and a polishing pad on the surface of the flexible membrane;

applying energy to said lap to cause said castable material to become fluid;

pressing said polishing pad against the back surface of said lens causing said membrane to deform so that its convex curvature is complementary to the lens' prescription concave curvature without creating non-uniform forces along the surface of said membrane; and removing energy from said lap so that said castable material solidifies and said membrane retains its complementary convex curvature.

18. A method for casting an ophthalmic lens polishing lap, comprising:

providing a lens having a rough cut back surface with a prescription curvature;

providing an ophthalmic lens polishing lap that includes a mounting plate with a conduit, a mass of castable material, a flexible membrane affixed to said mounting plate and encasing said mass, and a polishing pad on the surface of the flexible membrane;

applying energy to said lap by circulating relatively hot liquid through the conduit to cause said castable material to become fluid;

pressing said polishing pad against the back surface of said lens causing said membrane to deform so that its curvature is complementary to the lens' prescription curvature; and removing energy from said lap by circulating relatively cold liquid through the conduit so that said castable material solidifies and said membrane retains its complementary curvature.

19. A method for casting a lap to polish a plurality of lenses that have different back surface prescription concave curvatures, comprising:

(a) providing a lens polishing machine that includes a positioning mechanism for aligning and pressing together a lap and a lens, and includes a drive mechanism for rubbing them together to polish the lens;

(b) connecting a lap to said drive mechanism, said lap including a mounting plate adapted for connection to said drive mechanism, a mass of castable material on a front surface of the mounting plate and protruding therefrom, a flexible membrane that is affixed to said mounting plate and encases said mass so that the flexible membrane has a convex curvature, and a polishing pad on the surface of the flexible membrane;

(c) connecting one of said lenses to said drive mechanism;

(d) actuating said positioning mechanism to align said lap and said lens;

(e) applying energy to said lap such that said castable material becomes fluid;

(f) actuating said positioning mechanism to press said polishing pad against the back surface of said lens causing said membrane to deform so that its curvature is complementary to the lens' prescription concave curvature without creating non-uniform forces among the surface of said membrane;

(g) removing energy from said lap so that said castable material solidifies and said membrane retains its complementary convex curvature;

(h) actuating said drive mechanisms to rub said lens and said lap relative together to polish the back surface of said first lens; and (i) replacing said polished lens with the next unpolished lens and repeating steps d through h.

20. A method for casting a lad to polish a plurality of lenses that have different back surface prescription curvatures, comprising;

(a) providing polishing machine that includes a positioning mechanism for aligning and pressing together a lap and a lens, and includes its drive mechanism for rubbing them together to polish the lens;

(b) connecting all to said drive mechanism, said lap including a mounting plate with a conduit and adapted for connection to said drive mechanism, a mass of castable material, a flexible membrane that is affixed to said mounting plate and encases said mass, and a polishing pad on the surface of the flexible membrane;

(c) connecting one of said lenses to said drive mechanism;

(d) actuating said positioning mechanism to align said lap and said lens;

(e) applying energy to said lap by circulating relatively hot liquid through the conduit such that said castable material becomes fluid;

(f) actuating said positioning mechanism to press said polishing pad against the back surface of said lens causing said membrane to deform so that its curvature is complementary to the lens' prescription curvature;

(g) removing energy from said lap by circulating relatively cold liquid through the conduit so that said castable material solidifies and said membrane retains its complementary curvature;

(h) actuating said drive mechanisms to rub said lens and said lap relative together to polish the back surface of said first lens; and (i) replacing said polished lens with the next unpolished lens and repeating steps d through h.

* * * * *